US007919439B2

(12) United States Patent
Sasaki et al.

(10) Patent No.: US 7,919,439 B2
(45) Date of Patent: Apr. 5, 2011

(54) POWDERED LUBRICANT COMPOSITION FOR HOT WORKING AND METHOD FOR MANUFACTURING SEAMLESS TUBES

(75) Inventors: Kenichi Sasaki, Wakayama (JP); Sumio Iida, Takarazuka (JP); Shizuo Mori, Yokohama (JP); Atsushi Ito, Yokohama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 969 days.

(21) Appl. No.: 11/798,950

(22) Filed: May 18, 2007

(65) Prior Publication Data

US 2007/0287642 A1 Dec. 13, 2007

Related U.S. Application Data

(63) Continuation of application No. PCT/JP2005/021435, filed on Nov. 22, 2005.

(30) Foreign Application Priority Data

Nov. 22, 2004 (JP) ..... 2004-337074

(51) Int. Cl.
*C10M 125/26* (2006.01)
*C10M 125/10* (2006.01)
*C10M 129/40* (2006.01)

(52) U.S. Cl. ..... 508/156; 508/180; 508/536

(58) Field of Classification Search ..... 508/156, 508/180, 536

See application file for complete search history.

(56) References Cited

U.S. PATENT DOCUMENTS 4,308,182 A 12/1981 Eckard et al.

FOREIGN PATENT DOCUMENTS

| | | | |
|---|---|---|---|
| DE | 0303734 | | 2/1989 |
| JP | 56079193 | | 6/1981 |
| JP | 08-041474 | | 2/1996 |
| JP | 10-130687 | | 5/1998 |
| JP | 2000-226591 | | 8/2000 |
| JP | 2002-338984 | | 11/2002 |
| JP | 2002-338985 | | 11/2002 |
| JP | 2002338985 A | * | 11/2002 |

* cited by examiner

*Primary Examiner* — Glenn Caldarola
*Assistant Examiner* — Jim Goloboy
(74) *Attorney, Agent, or Firm* — Clark & Brody

(57) ABSTRACT

With a powdered lubricant composition by the invention, in addition to the blending of one of anhydrous, pentahydrate or decahydrate salt in sodium borate and one of sodium or calcium salt of fat acid, mixing calcium or lithium carbonate as an auxiliary lubricant can prevent sodium borate ($Na_2B_4O_7$), solidified as amorphous after a tube-making process, from moisture absorbance, drying and crystallization to thereby suppress the formation of $Na_2B_4O_7.5H_2O$ on inside surfaces of finished-product tubes, thus enabling to circumvent occurrence of the white scales. Concurrently, they provide good diffusivity toward the working surface of workpiece, thus enabling to prolong a life of the mandrel bar and to widely be adopted as the most suitable powdered lubricant for manufacturing seamless tubes by Mandrel Mill rolling.

18 Claims, 1 Drawing Sheet

POWDERED LUBRICANT COMPOSITION FOR HOT WORKING AND METHOD FOR MANUFACTURING SEAMLESS TUBES

This application is a continuation of International Patent Application No. PCT/JP2005/021435, filed Nov. 22, 2005. This PCT application was not in English as published under PCT Article 21(2).

BACKGROUND OF THE INVENTION

1. Field of the Invention

The present invention relates to the composition of a hot working powdered lubricant most suitable for Mandrel Mill rolling of seamless tubes and pipe (hereinafter, referred to as simply a "tube(s)") and a method for manufacturing seamless tubes by applying the same, and more particularly, to the composition of the hot working powdered lubricant, which enables to improve the quality of inside surface of finished-product tubes in Mandrel Mill rolling, and the method for manufacturing seamless tubes by applying the same.

2. Description of the Related Art

In steps of manufacturing seamless tubes by Mandrel Mill rolling, a round billet as a starting material is heated in a heating furnace, and then is subjected to a piercing-elongation rolling process to thereby obtain a hollow tube stock (also, referred to-as "hollow shell"), which is to be rolled subsequently. Next, a mandrel bar is inserted into the bore of the pierced hollow tube stock that is held at high temperatures in the range of 1000 to 1300° C. and an elongation-rolling process is applied to obtain a tube blank in the Mandrel Mill consisting of seven or eight pairs of grooved rolls in tandem wherein each pair thereof is out of phase by 90-degree to one another. Then after that, the tube blank thus obtained is reheated by a reheating furnace, when needed, and subjected to a finishing rolling by Stretch Reducer Mill to obtain finished-product tubes with predetermined dimensions.

When the hollow tube stock is subjected to the elongation-rolling process, relative sliding motion occurs at the interacting surface between the inside surface of the hollow tube stock and the outer surface of the mandrel bar. In Mandrel Mill rolling, it is a key technological issue to maintain the interacting surface in a good lubricating condition so as to smoothly let the relative sliding motion occur. To that end, a lubricant is usually applied on an interacting surface to secure a low and stable friction co-efficient, thereby enabling to prevent seizures between the hollow tube stock and the mandrel bar, while obtaining a good quality of inside surface of and good dimensional accuracy of finished-product tubes.

As the lubrication method above, a method for forming a solid lubrication film is applied in such a way that a water-dispersed type lubricant mainly consisting of graphite and resin-type organic binder is coated and dried over the surface of mandrel bar prior to be inserted into a hollow tube stock.

Meanwhile, as the lubricant to be used rendering it attached on the working surface of hollow tube stock, various lubricants have been studied in succession thus far, and any one is yet to exhibit sufficient effect. In particular, a technological improvement in Mandel Mill rolling is remarkably made, so that in Retained Mandrel Mill rolling, a required friction co-efficient of lubricant and quality of inside surface of finished-product tubes are not fully met yet.

Further, in Full Retract Mandrel Mill that recently becomes popular, a shorter mandrel bar is adopted in subjecting a longer length tube blank to an elongation-rolling process, so that the reduction of the friction co-efficient becomes essential and conventional lubricants put heavier burden on the mandrel bar, wherein seizures are very likely to be generated to lower the quality of the inside surface.

In this regard, Japanese Patent Application Publication No. 2002-338984 proposes the composition of powdered lubricants for hot working wherein by virtue of optimizing physical properties thereof in a powder state so as to be homogeneously sprayed to the predetermined working positions when sprayed into the inside surface of hollow tube stock, the reduction of friction between a hollow tube stock and a mandrel bar can be achieved, which is made up of a primary component including sodium borate in pentahydrate and an auxiliary lubricant including sodium carbonate and the like.

When the powdered lubricants proposed in Patent Application Publication above are used in Mandrel Mill rolling, not only operability can be improved because they are easily handled, but also the friction between the hollow tube stock and the mandrel bar during rolling can greatly be reduced, whereby inside-surface defects to be generated for finished-product tubes can be suppressed.

On the other hand, as a surface layer of a Cr-plated mandrel bar is typically covered with chromium oxide and passivated, corrosion hardly occurs, but when brought into contact with substances such as sodium borate that dissolve metal oxide at high temperatures, the chromium oxide on the Cr-plated surface may happen to be dissolved to result in a kind of corrosion-wear.

To cope with this, Japanese Patent Application Publication No. 2002-338985 proposes the composition of powdered lubricants for hot working which comprise sodium borate and the like, wherein a corrosion damage of a Cr layer on the surface layer of mandrel bar can be suppressed, while enabling to extend a tool life. When these powdered lubricants are used in Mandrel Mill rolling, not only the corrosion-wear on the Cr-plated surface can be suppressed but also the span of life of hot working tool can be prolonged, while the stable quality of inside surface of finished-product tubes can be secured.

SUMMARY OF THE INVENTION

By adopting the composition of powdered lubricants for hot working proposed in the above Japanese Patent Application Publications (Japanese Patent Application Publication Nos. 2002-338984 and 2002-338985), while their basic makeup is arranged such that a primary component is sodium borate and an auxiliary lubricant including sodium carbonate is blended, in Mandrel Mill rolling where these are placed on the working surface of hollow tube stock at high temperatures such as the range of 1000-1300° C., these instantly melt and fuse scales generated on the working surface to be a liquid-like mass to thereby spread over the working surface. Simultaneously, the rotation of the hollow tube stock in association of elongation-rolling contributes to diffuse spreading much more homogeneously, without deteriorating lubrication function thereof, thereby enabling to obtain finished-product tubes constantly free from inside-surface defects.

However, when the above composition of powdered lubricants are used in Mandrel Mill rolling, although not immediately after the completion of tube-making, the white deposits (hereinafter, referred to as the "white scales") in a granular form, like a blow-out, or in an exuded-layer form, may happen to generate in accompany of storing the finished-product tubes.

Such kind of white scales does not affect performance as a final product, but should degrade appearance aspect. Accordingly, shot blasting needs to be applied to the inside surface to remove the white scales, thus requiring a cumbersome treatment and huge costs for the treatment.

The present invention is attempted in view of the above-mentioned problem, and its object is to provide a powdered lubricant composition for hot working and a method for manufacturing seamless tubes by applying the same wherein in manufacturing seamless tubes by Mandel Mill rolling, not only white scales to be generated on the inside surface of finished-product tubes can be suppressed but also lubrication function thereof is assured during rolling, while enabling to extend a life expectancy of mandrel bar and to suppress the generation of inside-surface defects.

The present inventors, to solve the above-mentioned problem, precisely looked into the cause of generation of white scales on the inside surface of finished-product tubes in Mandrel Mill rolling. As afore-mentioned, the white scales do not appear immediately after rolling, but generates in accompany of storage of finished-product tubes. And, the composition of the powdered lubricant that is liable to generate the white scales comprise a primary component including sodium borate ($Na_2B_4O_7$) and an auxiliary lubricant including sodium carbonate ($Na_2CO_3$).

Just after Mandrel Mill rolling, the constituents of the powdered lubricant deposited on the working surface of hollow tube blank at high temperatures react with mill scales to result in a mixture of molten sodium borate ($Na_2B_4O_7$) and an excess of sodium borate ($Na_2B_4O_7$) that is supplied with allowance, thus ending up in solidifying as amorphous. Then, this amorphous is repeatedly subjected to absorbing moisture and drying to result in crystallizing as $Na_2B_4O_7.5H_2O$, thereby generating the white scales.

As a supportive evidence of the above-mentioned mechanism of the generation of white scales, it is confirmed that when sodium carbonate ($Na_2CO_3$) as the auxiliary lubricant is contained, the white scales appear to generate intensively. This phenomenon can be explained by the reactions shown by the equation (1) below:

$$Na_2B_4O_7+Na_2CO_3 \rightarrow 4.NaBO_2+CO_2. \quad (1)$$

FIG. 1 is a diagram showing a calculation result of Gibbs free energy in the equation (1) above, wherein the reaction temperature range for crystallization of sodium borate ($Na_2B_4O_7$) due to sodium carbonate ($Na_2CO_3$) is depicted, indicating that the reactions proceed in a left-to-right fashion under a condition of $\Delta G>0$.

From the result shown in FIG. 1, in the temperature range of about 350° C. or more, i.e. just after Mandrel Mill rolling, the reaction indicated by the equation (1) above proceeds in a left-to-right fashion to result in yielding $NaBO_2$. Table 1 shows the solubility of boric acid salt.

TABLE 1

| Chemical Formula | Solubility (Water 100 ml) |
|---|---|
| $NaBO_2$ | 26 g (20° C.) |
| $Na_2CO_3$ | 1.6 g (10° C.) |
| | 14.2 g (55° C.) |

As shown in Table 1, $NaBO_2$ formed just after rolling is greater in solubility than $Na_2CO_3$ to thereby absorb moisture easily, so that the repeated drying causes crystallization. Then, in association with storing a finished-product tube at room temperature, the reaction indicated by the equation (1) above proceeds in a right-to-left fashion, thereby ending up in forming the white scales in a chemical form of $Na_2B_4O_7.5H_2O$ on the inside surface of the tube.

Based on the studied result above, the present inventors made various investigations on an auxiliary lubricant in place of sodium carbonate ($Na_2CO_3$), and eventually paid attention to calcium carbonate ($CaCO_3$) and lithium carbonate ($Li_2CO_3$), both of which have an excellent high-temperature fluidity as well as a sufficient lubrication function, being required for an auxiliary lubricant.

Namely, similarly to the sodium carbonate ($Na_2CO_3$), the calcium carbonate ($CaCO_3$) as the auxiliary lubricant can lower the viscosity of prime lubricant, and can also exhibit the equivalent lubrication function, while its solubility to a 100-ml water is 1.4 mg (25° C.) or 1.8 mg (75° C.), which is legitimately low.

The lithium carbonate ($Li_2CO_3$) as the auxiliary lubricant, similarly to the sodium carbonate ($Na_2CO_3$), can lower the viscosity of prime lubricant, and can also exhibit the equivalent lubrication function, while its solubility to a 100-ml water is 1.54 g (0° C.) or 0.73 g (100° C.), which is legitimately low. Therefore, using the calcium carbonate ($CaCO_3$) and/or lithium carbonate ($Li_2CO_3$) as the auxiliary lubricant enables to circumvent the generation of the white scales that is associated with the moisture absorbance, drying and crystallization after Mandrel Mill rolling.

The present invention is accomplished based on the above findings, and its gist pertains to a powdered lubricant composition for hot working described in (1) below and to a method for manufacturing seamless tubes described in (2) below.

(1) A powdered lubricant composition for hot working which is used in hot working, comprising a blend of: a first group consisting of one or more of anhydrous sodium borate, sodium borate pentahydrate and sodium borate decahydrate, the first group accounting for 40-90 mass %; a second group consisting of one or two of calcium carbonate and lithium carbonate, the second group accounting for 5-30 mass %; and a third group consisting of one or two of sodium salt of fat acid and calcium salt of fat acid, the third group accounting for 5-30 mass %.

It is preferable that said sodium borate pentahydrate is blended more, accounting for 40-90 mass %.

(2) A method for manufacturing seamless tubes comprising the step of a Mandrel Mill rolling process after the powdered lubricant having the composition described in (1) above is supplied on the working surface of workpiece that is heated to a predetermined temperature. The predetermined temperature can be in the range of 1000 to 1300° C. at an inside surface of hollow tube stock.

According to the powdered lubricant composition of the present invention, blending calcium carbonate as the auxiliary lubricant can prevent the sodium borate ($Na2B_4O_7$), being solidified as amorphous after a tube-making process, from the moisture absorbance, drying and crystallization to thereby suppress the formation of $Na_2B_4O_7.5H_2O$ on the inside surface of the finished-product tubes, thus enabling to circumvent occurrence of the white scales.

Concurrently, they are excellent in solidification characteristics and fluidity in a powder state, and have good diffusivity toward the working surface of workpiece, so that a lubrication function during Mandrel Mill rolling can be maintained to thereby reduce a friction co-efficient between a mandrel bar and an inside surface of tube, thus enabling to prolong a span of life of the mandrel bar, while enabling to reduce generation of inside-surface defects of tube.

DETAILED DESCRIPTION OF THE PREFERRED EMBODIMENTS

Figure 1:
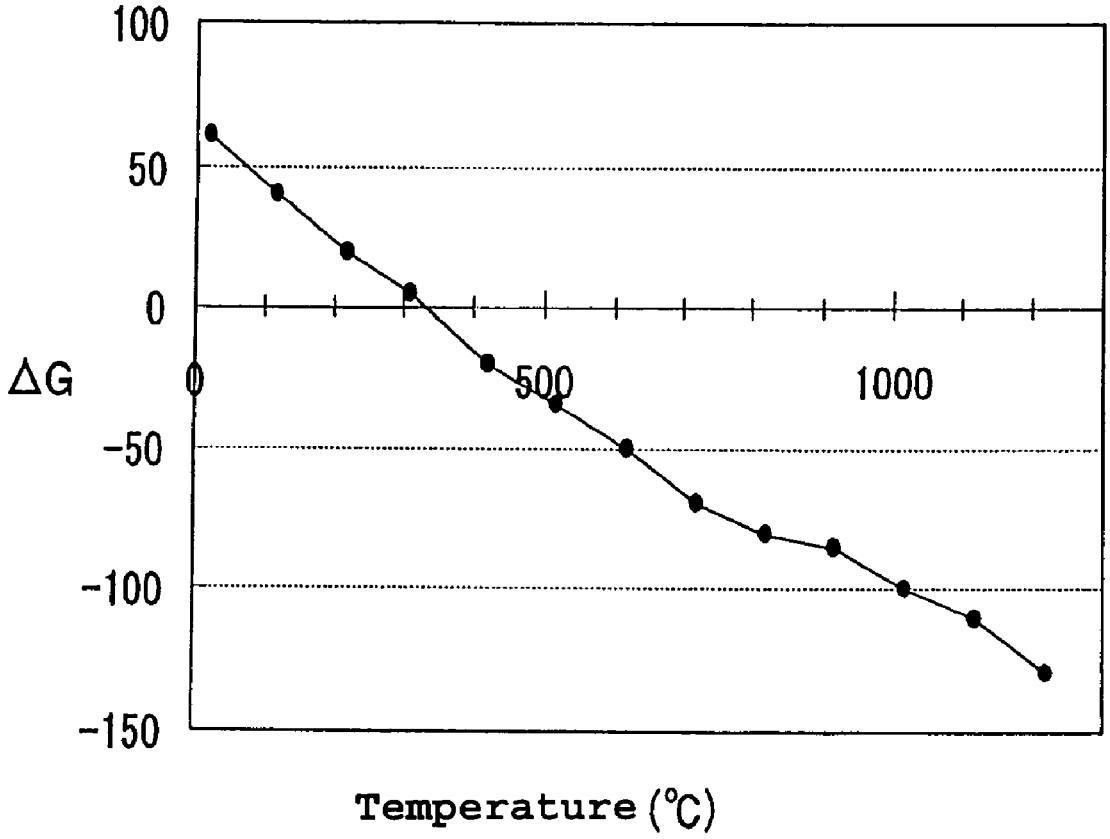
FIG. 1 is a diagram showing a calculation result of Gibbs free energy, wherein the temperature range for crystallization reactions of sodium borate ($Na_2B_4O_7$) due to sodium carbonate ($Na_2CO_3$) is depicted.

A powdered lubricant composition for hot working by the present invention, by blending calcium carbonate or lithium carbonate as an auxiliary lubricant, can secure a lubrication function in Mandrel Mill rolling and can prevent the white scales from occurring on inside surfaces of finished-product tubes after a tube-making process.

Accordingly, the powdered lubricant composition for hot working of the present invention which is used in hot working, comprise a blend of a first group consisting of one or more of anhydrous sodium borate, sodium borate pentahydrate and sodium borate decahydrate, the first group accounting for 40-90 mass %; a second group consisting of one or two of calcium carbonate and lithium carbonate, the second group accounting for 5-30 mass %; and a third group consisting of one or two of sodium salt of fat acid and calcium salt of fat acid, the third group accounting for 5-30 mass %.

In the present invention, the sodium borate group is a primary component of the lubricant to be blended in order to secure fluid lubrication characteristics and scales-fusing capability, wherein one or more of anhydrous sodium borate, sodium borate pentahydrate and sodium borate decahydrate, accounting for 40-90 mass %, needs to be blended in use.

Namely, when less than 40 mass %, other effective constituents are to be excessively mixed to result in decreasing the lubricant viscosity and deteriorating lubrication function after all. And when being more than 90 mass %, other effective constituents are to be deficiently mixed to result in not only disabling to reduce the friction co-efficient but also deteriorating physical properties in a powder state. A blend ratio of these salt forms of sodium borate is preferably 50-80 mass %.

Among salt forms of sodium borate set forth in the present invention, anhydrous salt does not contain crystallization water, so that no bubble is released when adhered to the workpiece at high temperatures, whereby homogeneous and uniform spraying-and-coating may not be assured. Meanwhile, the salt in a decahydrate form contains a lot of crystallization water, so that excessive bubbles are to be released to thereby make it difficult to sufficiently adhere to predetermined positions due to the bubble force during spraying-and-coating, and what is more, by letting out the crystallization water, the sodium borate itself may happen to melt and condensate.

In contrast, the salt in a pentahydrate form contains a proper amount of crystallization water, so that there is no concern about bubbles-release deficiency and condensation due to the let-out of crystallization water and excellent- physical properties (solidification characteristics in storing, fluidity during transportation and the like) in a powder state can be expected, while having greater effects on providing diffusivity at the time of spraying-and-coating, thus becoming preferable to be blended in a greater amount or to compose the whole makeup singly.

The above-mentioned sodium borate has excellent reactivity with the workpiece in terms of fluid lubrication characteristics, scales-fusing capability and the like, so the lubrication function can be secured, while the molten solution results in having comparatively high viscosity. Accordingly, mixing calcium carbonate and/or lithium carbonate as the auxiliary lubricant makes it possible to reduce the viscosity of the lubricant to homogeneously be diffused over the working surface, thus enabling to secure the lubrication function over the entire surface. Besides, it can exhibit the function such that when scales likely to cause defects on the working surface are present, the scales are promptly fused.

Further, since calcium carbonate and lithium carbonate have low solubility to water, it becomes possible to prevent the moisture absorbance by the primary component of the lubricant that detains on the inside surface of the finished-product tubes after Mandrel Mill rolling and to prevent the reactions that should result in drying and crystallization, thereby enabling to prevent the white scales from occurring.

However, when the makeup of calcium carbonate and/or lithium carbonate is less than 5 mass %, the viscosity cannot be reduced, so that the homogeneous and uniform lubrication over the working surface cannot be secured. On the other hand, when more than 30 mass %, the viscosity gets excessively low, resulting in deteriorating the lubrication function.

Therefore, the present invention specifies the blending of one or two of calcium carbonate and lithium carbonate, accounting for 5-30 mass %, preferably 10-20 mass %. It is preferable that the calcium carbonate, being cheaper than lithium carbonate, is used singly as the auxiliary lubricant or with a greater blending ratio therein.

Sodium salt of fat acid and calcium salt of fat acid are essential to attain the favorable properties of the lubricant in a powder state. However, with less than 5 mass % in blend ratio, smooth mobilization during transportation in piping cannot be attained, thereby resulting in putting heavier burdens on transfer machines to likely incur troubles. And, with more than 30 mass %, when charged onto the high-temperature workpiece, they are instantly combusted and the resultant combustion gas causes the powdered lubricant itself to excessively be diffused to be discharged outside the workpiece, whereby not only the deposit amount thereof gets less to aggravate the lubrication but also it ends up uneconomical. Hence, the present invention specifies the blending of sodium salt of fat acid and calcium salt of fat acid to be 5-30 mass %, preferably 8-20 mass %.

As the sodium salt of fat acid or the calcium salt of fat acid that can be used in the present invention, there is the salt of saturated fatty acid such as stearic acid and palmitic acid, or the salt of natural vegetable fat and oil, i.e., palm oil fat acid or fat acid of palm kernel oil, or the salt of fat acid that is obtained from animal fat and oil, i.e., tallowate fat acid and the like.

By depositing the powdered lubricant for hot working with the composition of the present invention over the working surface of the workpiece that is heated to the predetermined temperatures, during Mandrel Mill rolling of whether stainless steel or high alloy steel, it becomes possible to reduce the friction co-efficient at the interface between the mandrel bar and the tube inside surface to thereby secure the lubrication function. Further, even in a long-term storage after the tube-making process, the white scales never happen to occur on the inside surfaces of the finished-product tubes.

EXAMPLES

Effects and merits that the composition of powdered lubricant for hot working by the present invention can exhibit are recited on the basis of the evaluation test using an electric furnace and the evaluation campaign using commercial plant.

Example 1

The electric furnace is used to make an evaluation test on the lubrication function (high temperature fluidity) and occurrence of the white scales. Table 2 shows the compositions of the tested lubricant. By the way, the compositional condition of the tested lubricant is set as below.

Anhydrous sodium borate: average grain size; about 0.6 mm, purity; 98% or more

Sodium borate pentahydrate: average grain size; about 0.4 mm, purity; 98% or more Sodium borate decahydrate: average grain size; about 0.3 mm, purity; 98% or more Calcium carbonate: average grain size; about 0.1 mm, purity; 98% or more Sodium carbonate: average grain size; about 0.3 mm, purity; 99% or more Sodium salt of fat acid (sodium salt of tallowate fat acid): about 0.3 mm, purity; 95% or more Calcium salt of fat acid (calcium salt of stearic acid): about 0.4 mm, purity; 97% or more Occurrence of the white scales after being left out in air for 30 days is evaluated such that a symbol o designates no occurrence of the white scales and a symbol x designates the occurrence of the white scales.

As shown in Table 2, any tested lubricant among the Inventive Example Nos. 1-8 that conform to the specified composition by the present invention proves to be have an excellent lubrication function and excellent effects on preventing the occurrence of the white scales.

In contrast, in case of the Comparative Example Nos. 1 and 2, since the calcium carbonate as the auxiliary lubricant was not or deficiently blended, the lubrication function turned out to be poor. Further, in the Comparative Example No. 3, since the sodium carbonate was blended, the moisture absorbance and crystallization took place during being left out in air to generate the white scales that were observed.

TABLE 2

| | Sodium Borate (Primary Component) | | | Auxiliary Lubricant | | Fat Acid | | Evaluation Result | |
|---|---|---|---|---|---|---|---|---|---|
| Classification | Anhydrous Salt | Pentahydrate Salt | Decahydrate Salt | Calcium Carbonate | Sodium Carbonate | Sodium Salt | Calcium Salt | Lubrication Function | White Scales |
| Inventive Example 1 | 65 | | | 20 | 0 | 7.5 | 7.5 | ◎ | ○ |
| Inventive Example 2 | | 50 | | 30 | 0 | 10 | 10 | ◎ | ○ |
| Inventive Example 3 | | | 40 | 30 | 0 | 15 | 15 | ○ | ○ |
| Inventive Example 4 | 40 | | | 30 | 0 | 30 | 0 | ○ | ○ |
| Inventive Example 5 | | 40 | | 30 | 0 | 0 | 30 | ○ | ○ |
| Inventive Example 6 | | | 90 | 5 | 0 | 2.5 | 2.5 | ○ | ○ |
| Inventive Example 7 | 90 | | | 5 | 0 | 0 | 5 | ○ | ○ |
| Inventive Example 8 | | 90 | | 5 | 0 | 5 | 0 | ○ | ○ |
| Comparative Example 1 | 90 | | | *4 | 0 | 6 | 0 | Δ | ○ |
| Comparative Example 2 | | 90 | | *0 | 0 | 5 | 5 | X | ○ |
| Comparative Example 3 | | | 84 | 0 | *6 | 5 | 5 | ○ | X |

Note:
Any figure in the Table designates a blend ratio in mass %.
The symbol * designates the deviation from the specified range by the present invention.

As regards the evaluation test, an electric furnace ($N_2$ atmosphere) set at 1000° C. was adopted, wherein test coupons of 150 mm×150 mm×5 mm in size were placed with a slope of 7 degree and were heated for 10 minutes. After that, the tested lubricants designated as Inventive Example Nos. 1-8 and Comparative Example Nos. 1-3 were applied on the test coupons respectively, that were subsequently held therein for 3 minutes further, taken out of the electric furnace, released in air for cooling, and finally subjected to the observation check for the lubrication function (fluidity).

In evaluating the lubrication function, a symbol ◎ designates that an excellent diffusion is observed, whereas a symbol o designates that a diffusion is observed, and whereas a symbol A designates that a few diffusion is observed, and whereas a symbol x designated that no diffusion is observed or the diffusion is hardly observed.

Example 2

In EXAMPLE 2, lithium carbonate as an auxiliary lubricant was used in place of the calcium carbonate, and similarly to EXAMPLE 1, an evaluation test for lubrication function (high temperature fluidity) and occurrence of the white scales was carried out. Compositions of tested lubricants are listed in Table 3. Except that an average grain size and purity of the calcium carbonate were set to about 0.1 mm and about 99% respectively, other compositional conditions were set to be the same with those for EXAMPLE 1 and the evaluation test for lubrication function was made and occurrence of the white scales was observed.

TABLE 3

| | Sodium Borate (Primary Component) | | | Auxiliary Lubricant | | Fat Acid | | Evaluation Result | |
|---|---|---|---|---|---|---|---|---|---|
| Classification | Anhydrous Salt | Pentahydrate Salt | Decahydrate Salt | Lithium Carbonate | Sodium Carbonate | Sodium Salt | Calcium Salt | Lubrication Function | White Scales |
| Inventive Example 9 | 65 | | | 20 | 0 | 7.5 | 7.5 | ◎ | ○ |
| Inventive Example 10 | | 50 | | 30 | 0 | 10 | 10 | ◎ | ○ |
| Inventive Example 11 | | | 40 | 30 | 0 | 15 | 15 | ○ | ○ |
| Inventive Example 12 | 40 | | | 30 | 0 | 30 | 0 | ○ | ○ |
| Inventive Example 13 | | 40 | | 30 | 0 | 0 | 30 | ○ | ○ |
| Inventive Example 14 | | | 90 | 5 | 0 | 2.5 | 2.5 | ○ | ○ |
| Inventive Example 15 | 90 | | | 5 | 0 | 0 | 5 | ○ | ○ |

TABLE 3-continued

| Classification | Sodium Borate (Primary Component) | | | Auxiliary Lubricant | | Fat Acid | | Evaluation Result | |
|---|---|---|---|---|---|---|---|---|---|
| | Anhydrous Salt | Pentahydrate Salt | Decahydrate Salt | Lithium Carbonate | Sodium Carbonate | Sodium Salt | Calcium Salt | Lubrication Function | White Scales |
| Inventive Example 16 | | 90 | | 5 | 0 | 5 | 0 | ○ | ○ |
| Comparative Example 4 | 90 | | | *4 | 0 | 6 | 0 | Δ | ○ |

Note:
Any figure in the Table designates a blend ratio in mass %.
The symbol * designates the deviation from the specified range by the present invention.

As shown in Table 3, any tested lubricant among the Inventive Example Nos. 9-16 that conform to the specified composition by the present invention proves to be have an excellent lubrication function and excellent effects on preventing the occurrence of the white scales. In contrast, in case of the Comparative Example No. 4, since the lithium carbonate as the auxiliary lubricant was deficiently blended, the lubrication function turned out to be poor.

Example 3

A 5-stand Full Retract Mandrel Mill was adopted as a rolling equipment to make an evaluation campaign in a commercial plant operation for a friction coefficient and occurrence of the white scales. The compositional conditions of the tested lubricants are the same with those in EXAMPLES 1 and 2, and the compositions of the tested lubricants are listed in Table 4.

TABLE 4

| Classification | Sodium Borate (Primary Component) | | | Auxiliary Lubricant | | | Fat Acid | | Evaluation Result | |
|---|---|---|---|---|---|---|---|---|---|---|
| | Anhydrous Salt | Pentahydrate Salt | Decahydrate Salt | Calcium Carbonate | Lithium Carbonate | Sodium Carbonate | Sodium Salt | Calcium Salt | Friction Co-efficient | White Scales |
| Inventive Example 17 | 65 | | | 20 | 0 | 0 | 7.5 | 7.5 | ○ | ○ |
| Inventive Example 18 | 65 | | | 0 | 20 | 0 | 7.5 | 7.5 | ○ | ○ |
| Comparative Example 5 | | 65 | | 0 | 0 | *20 | 7.5 | 7.5 | ○ | X |
| Comparative Example 6 | | | 85 | *0 | *0 | 0 | 7.5 | 7.5 | X | ○ |

Note:
Any figure in the Table designates a blend ratio in mass %.
The symbol * designates the deviation from the specified range by the present invention.

A workpiece made of plain steel was used, wherein in the 5-stand Full Retract Mandrel Mill rolling, the dimensions of a hollow shell prior to rolling were set to 330 mm in diameter, 18 mm in thickness and 7000 mm in length and the temperature prior to rolling was set to 1150° C. The mandrel bar that was used was 248 mm in diameter and 2400 mm in length, made of SKD6 steel grade and subjected to Cr-plating (50 μm in thickness) on its surface. An elongation-rolling process was applied so as to yield the finished tubes with the dimensions of 258 mm in diameter, 8 mm in thickness and 18300 mm in length after Mandrel Mill rolling.

As an injection method of lubricants, a carrier gas of 1.5 $kg/cm^2$ $N_2$ was injected from one end of the hollow shell prior to rolling, resulting in the injection of an amount of 1100 cc.

The friction co-efficient during Mandrel Mill rolling is evaluated by the value obtained in such a way that the retained force of the mandrel bar is divided by the sum of the load at each stand. In the evaluation, the case where the value above is less than 0.03 is regarded as o and the case where the value above is not less than 0.03 is regarded as x.

And the occurrence of the white scales after being left out in air for 30 days was evaluated, and the case where no white scales was discerned is regarded as o and the case where the white scales were observed is regarded as x.

As shown in Table 4, the tested lubricants in the Inventive Example Nos. 17 and 18 that conform to the specified composition by the present invention prove to be superior in terms of the friction co-efficient as well as the occurrence of the white scales. In contrast, in case of the Comparative Example No. 5, since the sodium carbonate was blended, the moisture absorbance and crystallization took place during being left out in air to generate the white scales that were observed, while in case of the Comparative Example No. 6, the calcium carbonate and/or lithium carbonate as an auxiliary lubricant was not blended to thereby result in having a poor friction co-efficient.

In succession, in order to confirm a proper temperature for hot working, the Inventive Example Nos. 17 and 18 shown in Table 4 were used in Mandrel Mill rolling where the temperature prior to the rolling was varied. The workpiece, mandrel bar and rolling schedule that were used were similarly arranged. Eventually, it was confirmed that the temperatures for hot working in the range of 1000 to 1300° C. prove to be superior in terms of the friction co-efficient as well as the occurrence of the white scales.

INDUSTRIAL APPLICABILITY

According to the powdered lubricant composition of the present invention, blending calcium carbonate as an auxiliary lubricant can prevent the sodium borate ($Na_2B_4O_7$), being solidified as amorphous after a tube-making process, from the moisture absorbance, drying and crystallization to thereby suppress the formation of $Na_2B_4O_7.5H_2O$ on an inside surface of finished-product tubes, thus enabling to circumvent occurrence of the white scales.

Concurrently, they are excellent in solidification characteristics and fluidity in a powder state, and have good diffusivity toward the working surface of workpiece, so that lubrication function during Mandrel Mill rolling can be maintained to thereby reduce a friction co-efficient between a mandrel bar and an inside surface of tube, thus enabling to extend a span of life of the mandrel bar, while enabling to reduce generation of inside-surface defects of tube. As such, they can widely be adopted as the most suitable powdered lubricant for manufacturing seamless tubes by Mandrel Mill rolling.

What is claimed is:

1. A powdered lubricant composition for hot working which is used in hot working, comprising a blend of:

a first group consisting of one or more components selected from the group consisting of anhydrous sodium borate, sodium borate pentahydrate and sodium borate decahydrate, the first group accounting for 40-90 mass %;

a second component selected from the group consisting of calcium carbonate, lithium carbonate, and mixtures thereof, the second component accounting for 5-30 mass % of said composition; and a third component selected from the group consisting of sodium salt of fat acid, calcium salt of fat acid, and mixtures thereof, the third component accounting for 5-30 mass % of said composition;

wherein sodium carbonate is not included as an auxiliary lubricant.

2. The powdered lubricant composition for hot working which is used in hot working according to claim 1, wherein said sodium borate pentahydrate is blended such that it accounts for 40-90 mass %.

3. A method for manufacturing seamless tubes, wherein a mandrel mill rolling process is applied after the powdered lubricant having the composition according to claim 1 is supplied on the working surface of workpiece that is heated to a predetermined hot working temperature.

4. The method for manufacturing seamless tubes, wherein a mandrel mill rolling process is applied after the powdered lubricant having the composition according to claim 2 is supplied on the working surface of workpiece that is heated to a predetermined hot working temperature.

5. The method for manufacturing seamless tubes according to claim 3, wherein said predetermined hot working temperature is set in the range of 1000 to 1300° C.

6. The method for manufacturing seamless tubes according to claim 4, wherein said predetermined hot working temperature is set in the range of 1000 to 1300° C.

7. A powdered lubricant composition for hot working which is used in hot working, comprising a blend of:

a first group consisting of one or more components selected from the group consisting of anhydrous sodium borate, sodium borate penta hydrate and sodium borate decahydrate, the first group accounting for 40-90 mass %;

a second component selected from the group consisting of calcium carbonate, lithium carbonate, and mixtures thereof, the second component accounting for 5-30 mass % of said composition a third component selected from the group consisting of sodium salt of fat acid, calcium salt of fat acid, and mixtures thereof, the third component accounting for 5-30 mass % of said composition wherein the inside surface of the product tube finished by mandrel mill rolling is free of white scales.

8. The powdered lubricant composition for hot working which is used in hot working according to claim 7, wherein said sodium borate pentahydrate is blended such that it accounts for 40-90 mass.

9. A method for manufacturing seamless tubes, wherein a mandrel mill rolling process is applied after the powdered lubricant having the composition according to claim 7 is supplied on the working surface of workpiece that is heated to a predetermined hot working temperature.

10. The method for manufacturing seamless tubes, wherein a mandrel mill rolling process is applied after the powdered lubricant having the composition according to claim 8 is supplied on the working surface of workpiece that is heated to a predetermined hot working temperature.

11. The method for manufacturing seamless tubes according to claim 9, wherein said predetermined hot working temperature is set in the range of 1000 to 1300° C.

12. The method for manufacturing seamless tubes according to claim 10, wherein said predetermined hot working temperature is set in the range of 1000 to 1300° C.

13. A powdered lubricant composition for hot working which is used in hot working, consisting of a blend of:

a first group consisting of one or more components selected from the group consisting of anhydrous sodium borate, sodium borate penta hydrate and sodium borate decahydrate, the first group accounting for 40-90 mass %;

a second component selected from the group consisting of calcium carbonate, lithium carbonate, and mixtures thereof, the second component accounting for 5-30 mass % of said composition a third component selected from the group consisting of sodium salt of fat acid, calcium salt of fat acid, and mixtures thereof, the third component accounting for 5-30 mass % of said composition.

14. The powdered lubricant composition for hot working which is used in hot working according to claim 13, wherein said sodium borate pentahydrate is blended such that it accounts for 40-90 mass %.

15. A method for manufacturing seamless tubes, wherein a mandrel mill rolling process is applied after the powdered lubricant having the composition according to claim 13 is supplied on the working surface of workpiece that is heated to a predetermined hot working temperature.

16. The method for manufacturing seamless tubes, wherein a mandrel mill rolling process is applied after the powdered lubricant having the composition according to claim 14 is supplied on the working surface of workpiece that is heated to a predetermined hot working temperature.

17. The method for manufacturing seamless tubes according to claim 15, wherein said predetermined hot working temperature is set in the range of 1000 to 1300° C.

18. The method for manufacturing seamless tubes according to claim 16, wherein said predetermined hot working temperature is set in the range of 1000 to 1300° C.

* * * * *